US007639194B2

(12) United States Patent
Chi et al.

(10) Patent No.: US 7,639,194 B2
(45) Date of Patent: Dec. 29, 2009

(54) DUAL-BAND LOOP ANTENNA

(75) Inventors: Yun-Wen Chi, Sinjhuang (TW); Kin-Lu Wong, Kaohsiung (TW)

(73) Assignee: Auden Techno Corp., Kaohsiung (TW)

( * ) Notice: Subject to any disclaimer, the term of this patent is extended or adjusted under 35 U.S.C. 154(b) by 0 days.

(21) Appl. No.: 12/186,584

(22) Filed: Aug. 6, 2008

(65) Prior Publication Data

US 2008/0291100 A1 Nov. 27, 2008

Related U.S. Application Data

(63) Continuation-in-part of application No. 11/564,893, filed on Nov. 30, 2006, now abandoned.

(51) Int. Cl.
*H01Q 1/24* (2006.01)
*H01Q 1/38* (2006.01)

(52) U.S. Cl. ..... 343/702; 343/728; 343/741

(58) Field of Classification Search ..... 343/700 MS, 343/702, 728, 729, 741, 846
See application file for complete search history.

(56) References Cited

U.S. PATENT DOCUMENTS 7,215,283 B2 * 5/2007 Boyle ..... 343/700 MS
2005/0264455 A1 * 12/2005 Talvitie et al. ..... 343/702

* cited by examiner

*Primary Examiner*—Michael C Wimer
(74) *Attorney, Agent, or Firm*—Ming Chow; Sinorica, LLC

(57) ABSTRACT

A dual-band loop antenna for using in a mobile phone for (890~960 MHz)/DCS(1710~1880 MHz) application is disclosed to include a ground plane in a substantially rectangular shape having a grounding point and a shorting point, a radiating metallic loop having a feeding end and a shorting end electrically connected to the shorting point of the ground plane and spaced from the feeding end at a predetermined distance, and a radiating metallic plate surrounded by the radiating metallic loop and having one end electrically connected to a vicinity around the shorting end of the radiating metallic loop and spaced from the shorting end of the radiating metallic loop at a distance less than 10 mm.

10 Claims, 7 Drawing Sheets

DUAL-BAND LOOP ANTENNA

CROSS-REFERENCE TO RELATED ART

The present invention is a continuation-in-part of U.S. application Ser. No. 11/564,893, entitled DUAL-BAND LOOP ANTENNA, filed on Nov. 30, 2006 now abandoned.

BACKGROUND OF THE INVENTION

1. Field of the Invention

The present invention relates to a loop antenna, and particularly, to a dual-band loop antenna to be built in a mobile telephone, which generates a half-wavelength mode and a full-wavelength mode of a radiating metallic loop thereof, and an additional half-wavelength mode by coupling between a radiating metallic plate thereof and the radiating metallic loop.

2. Description of the Related Art

Following fast development of wireless communication technology, a variety of wireless communication products have been developed and have appeared on the market. In wireless communication products, the antenna plays an important role. Under the tendency toward the design having light, thin, short and small characteristics, the height of the antenna of a wireless communication apparatus determines the value of the product. Modern wireless communication products commonly adopt internal planar antennas or external monopole antennas.

The internal planar antennas of conventional dual-band mobile telephones commonly have a height about 7-10 mm. A conventional dual-band planar inverted-F antenna is known comprising an internal or concealed cell phone antenna having a radiating metallic plate and a system ground plane for GSM (Global System for Mobile Communications) and DCS (Digital Cellular System) dual-band application. Because of the concealed cell phone antenna, the cell phone has a height over 10 mm.

When we have the aforesaid concealed cell phone antenna be used in a thin-thickness cell phone (of thickness about 10 mm or thinner), we will encounter a problem of over-sized antenna and will be unable to satisfy the requirements of having cell phones be realized in thin-thickness.

To avoid this problem, manufacturers commonly adopt a monopole antenna design in which the monopole antenna protrudes over the ground plane and is less affected by the ground plane, allowing the thickness of the cell phone to be minimized.

However, either a planar antenna or monopole antenna is used, subject to the limited space inside the cell phone, the antenna can cover only the bandwidth of the GMS band. When the environment of use is changed, for example, when the user holds the cell phone with the hand or keeps the cell phone close to his (her) head, the large dielectric coefficient of hand or head will cause a frequency shift, resulting in a decrease in cell phone radiation efficiency.

SUMMARY OF THE INVENTION

The present invention has been accomplished to provide a dual-band loop antenna that overcomes the aforesaid problems. It is therefore one object of the present invention to provide a dual-band loop antenna, which has the antenna be directly printed on a dielectric substrate to reduce the manufacturing cost and, which shows a broadband performance around GSM band to avoid the decreasing of the radiation efficiency due to frequency shift, wherein the lower resonant frequency (GSM band) is about 250 MHz (890~1140 MHz) and the bandwidth at the higher resonant frequency (DCS band) is about 170 MHz. Both of the lower and higher bands meet the requirements for the cell phone system in practical applications.

It is another object of the present invention to provide a dual-band loop antenna, which is applicable for the GSM (890~960 MHz) band as well as the DCS (1710~1880 MHz) band and, has simple structure, low cost and good radiation characteristics practical for industrial application.

To achieve these and other objects of the present invention, the dual-band loop antenna comprises a ground plane in a substantially rectangular shape, a radiating metallic loop and a radiating metallic plate. The ground plane comprises a grounding point and a shorting point. The radiating metallic loop comprises a feeding end and a shorting end. The feeding end and the shorting end are spaced from each other at a predetermined distance. The shorting end is electrically connected to the shorting point of the ground plane. The radiating metallic plate is surrounded by the radiating metallic loop, comprising one end electrically connected to a vicinity around the shorting end of the radiating metallic loop and spaced from the shorting end of the radiating metallic loop at a distance shorter than 10 mm.

The dual-band loop antenna generates a half-wavelength mode and a full-wavelength mode subject to the resonance of the radiating metallic loop, and an additional half-wavelength mode owing to the coupling between the radiating metallic plate and the radiating metallic loop. The former two resonant modes are formed to have an operating bandwidth of about 250 MHz (890~1140 MHz) close to 3.5 times of the requirement of the GSM band, and the return loss in the GSM band (890~960 MHz) of the antenna of the present invention is all better than 7.3 dB, meeting actual application requirements. The third resonant mode covers the requirement for DCS band operation, and the return loss in the required band (1710~1880 MHz) is all better than 7.3 dB, meeting actual application requirements.

Further, the design of the dual-band loop antenna has a simple structure. The dual-band loop antenna can be directly formed on a dielectric substrate by means of printing or etching without any additional processing process to mount the antenna to a radio signal line or system ground plane, thereby saving much the manufacturing cost.

DETAILED DESCRIPTION OF THE PREFERRED EMBODIMENT

Figure 1:
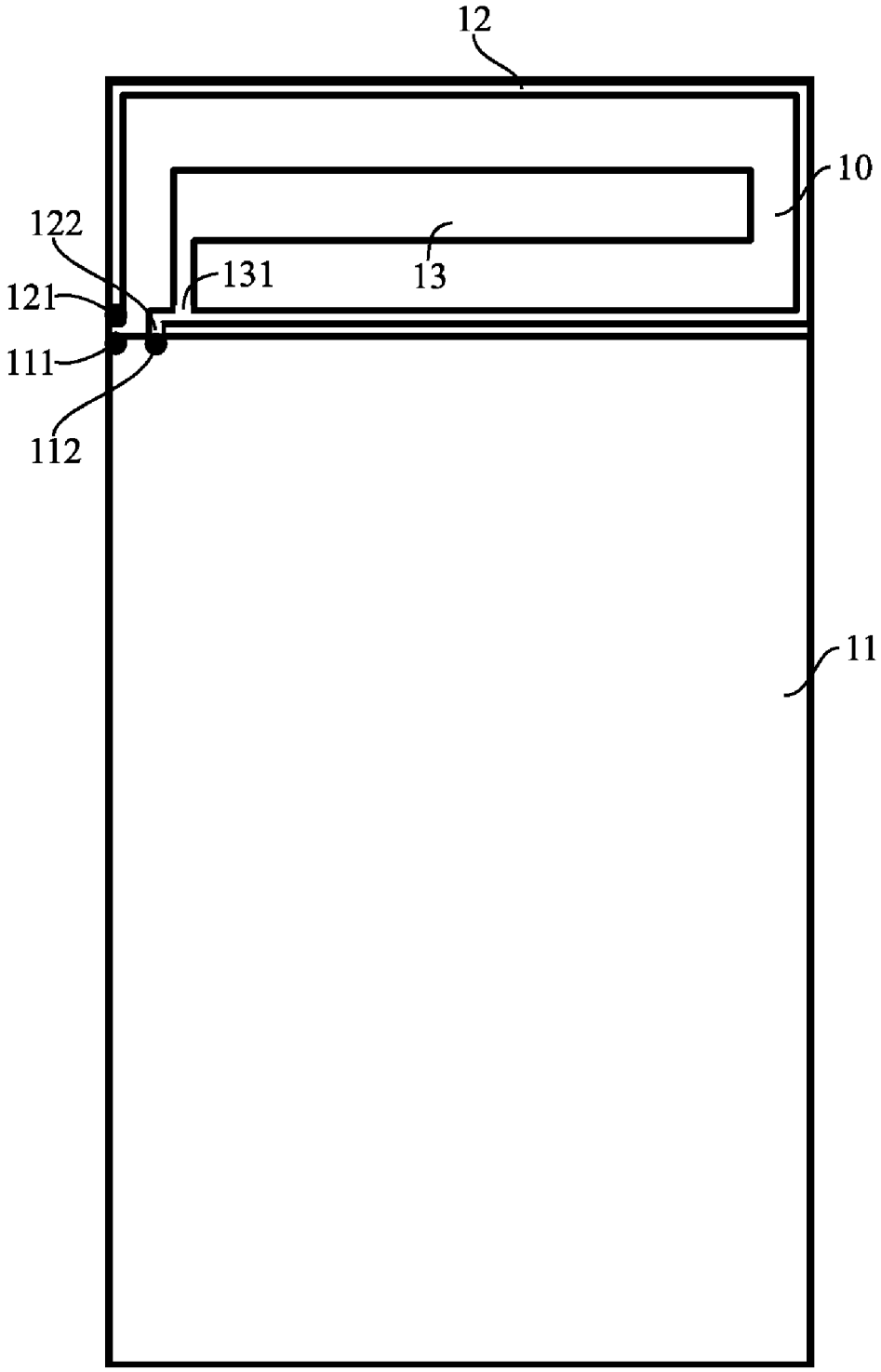
FIG. 1 is a schematic structural view of a dual-band loop antenna in accordance with a first embodiment of the present invention.

Referring to FIG. 1, a dual-band loop antenna in accordance with a first embodiment of the present invention is shown, which comprises a ground plane 11, a radiating metallic loop 12 and a radiating metallic plate 13. The ground plane 11, the radiating metallic loop 12 and the radiating metallic plate 13 are respectively formed on a dielectric substrate 10 by means of a printing or etching technique. The ground plane 11 shows a substantially rectangular shape, having a grounding point 111 and a shorting point 112. The radiating metallic loop 12 has a feeding end 121 and a shorting end 122. The feeding end 121 and the shorting end 122 are kept apart from each other at a distance not less than 5 mm. The shorting end 122 is electrically connected to the shorting point 112 of the ground plane 11. The radiating metallic plate 13 is surrounded by the radiating metallic loop 12. Further, the radiating metallic plate 13 has one end 131 electrically connected to a vicinity around the shorting end 122 and spaced from the shorting end 122 at a distance shorter than 10 mm.

When the above stated antenna of the present invention is used in a mobile phone system, the ground plane 11 is a system ground plane of the mobile phone system; a system module and circuit elements can be allocated thereon.

When the dual-band loop antenna of the first embodiment of the present invention is used in a cell phone, the ground plane 11 serves as the system ground plane of the cell phone for placing the system module and related circuit components.

Figure 2:
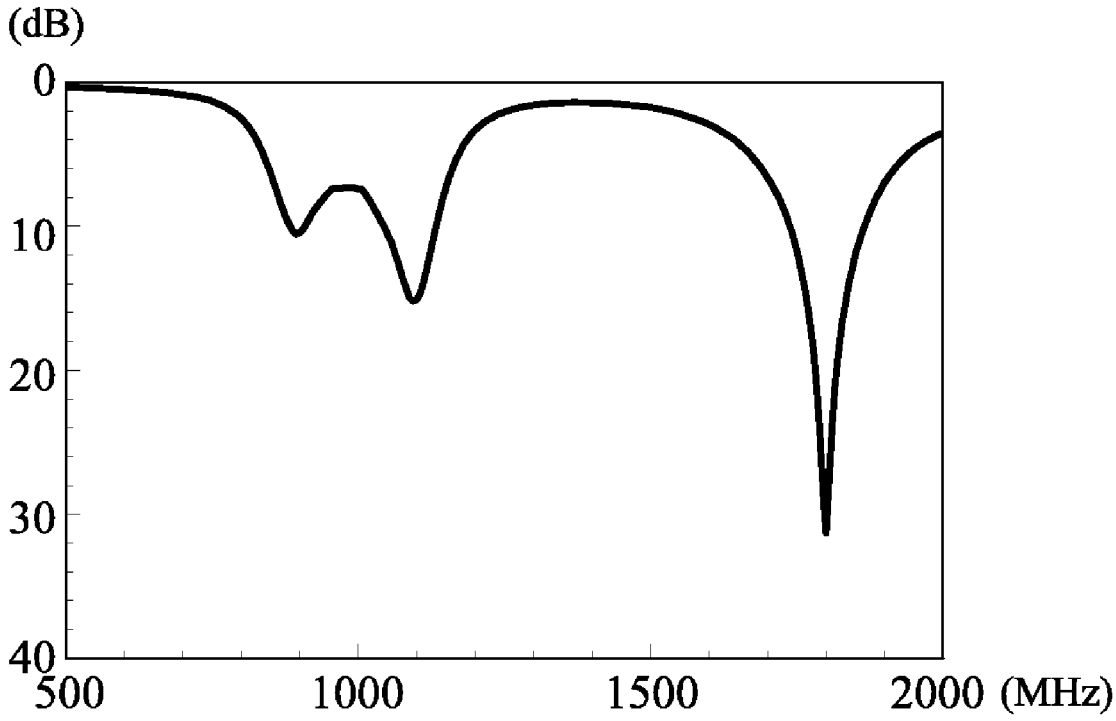
FIG. 2 is a schematic drawing showing the return loss measurement of the dual-band loop antenna in accordance with the first embodiment of the present invention.

FIG. 2 is a schematic drawing showing the return loss measurement of the dual-band loop antenna in accordance with the first embodiment of the present invention. The measurement was made on a dual-band loop antenna prototype with the following dimensions: the size of the ground plane 11: 50×100 $mm^2$; the antenna area: 50×15 $mm^2$; the antenna prototype mainly includes a radiating metallic loop 12 and a radiating metallic plate 13; the radiating metallic loop 12 and the radiating metallic plate 13 were formed with the system ground plane 11 on a 0.8 mm thick FR4 substrate 10 by means of a printing or etching technique; the width of the radiating metallic loop 12 is 0.5 mm; the radiating metallic loop 12 surrounded a rectangular area of size 50×15 $mm^2$ and had a total length about 127 mm; the radiating metallic loop 12 had its one end as a feeding end 121 and its other end as a shorting end 122 which are separated from each other with a distance 1 mm and the shorting end 122 is electrically connected to the system ground plane 11; one end of the radiating metallic loop 12 that was connected with the shorting point 112 of the ground plane 11 was spaced from the ground plane 11 with a gap of 0.5 mm; the radiating metallic plate 13 had an inverted-L shape comprised of a metallic plate body of size 4 mm long and 1 mm wide and a metallic arm of 41 mm long and 5 mm wide; the connecting area between the radiating metallic loop 12 and the radiating metallic plate 13 was spaced from the shorting end 122 of the radiating metallic loop 12 at 2.5 mm.

This design of dual-band loop antenna had three resonant modes, a half-wavelength mode and a full-wavelength mode resulted from the resonance of the radiating metallic loop 12, and an additional half-wavelength mode formed by the coupling between the radiating metallic plate 13 and the radiating metallic loop 12.

The former two resonant modes form an operating bandwidth of about 250 MHz (890~1140 MHz) close to 3.5 times of the required bandwidth for the GSM band (not like the conventional monopole antennas or planar antennas that simply can cover the GSM band), and the return loss over the operating band (890~960 MHz) is larger than 7.3 dB, suitable for practical application. The third resonant mode covered the DCS band, the return loss over this band (1710~1880 MHz) is larger than 7.3 dB, suitable for practical application.

Figure 3:
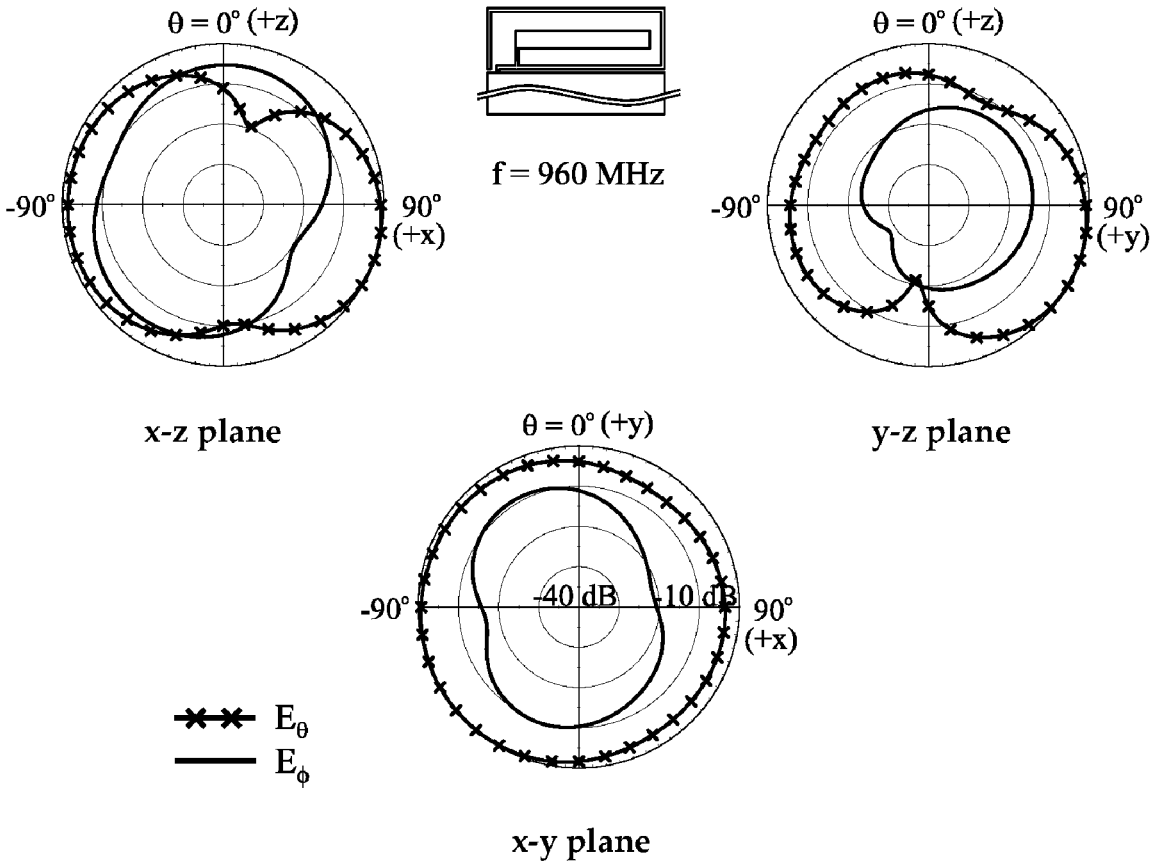
FIG. 3 illustrates the radiation pattern of the dual-band loop antenna at 960 MHz according to the first embodiment of the present invention.

FIG. 3 illustrates the radiation pattern of the dual-band loop antenna at 960 MHz according to the first embodiment of the present invention. As illustrated, the radiation pattern of the half-wavelength mode resulted from the resonance of the radiating metallic loop of the dual-band loop antenna at 960 MHz according to the present invention is substantially similar to the radiation pattern resulted from the resonance of a conventional monopole antenna or planar antenna at the same frequency.

Figure 4:
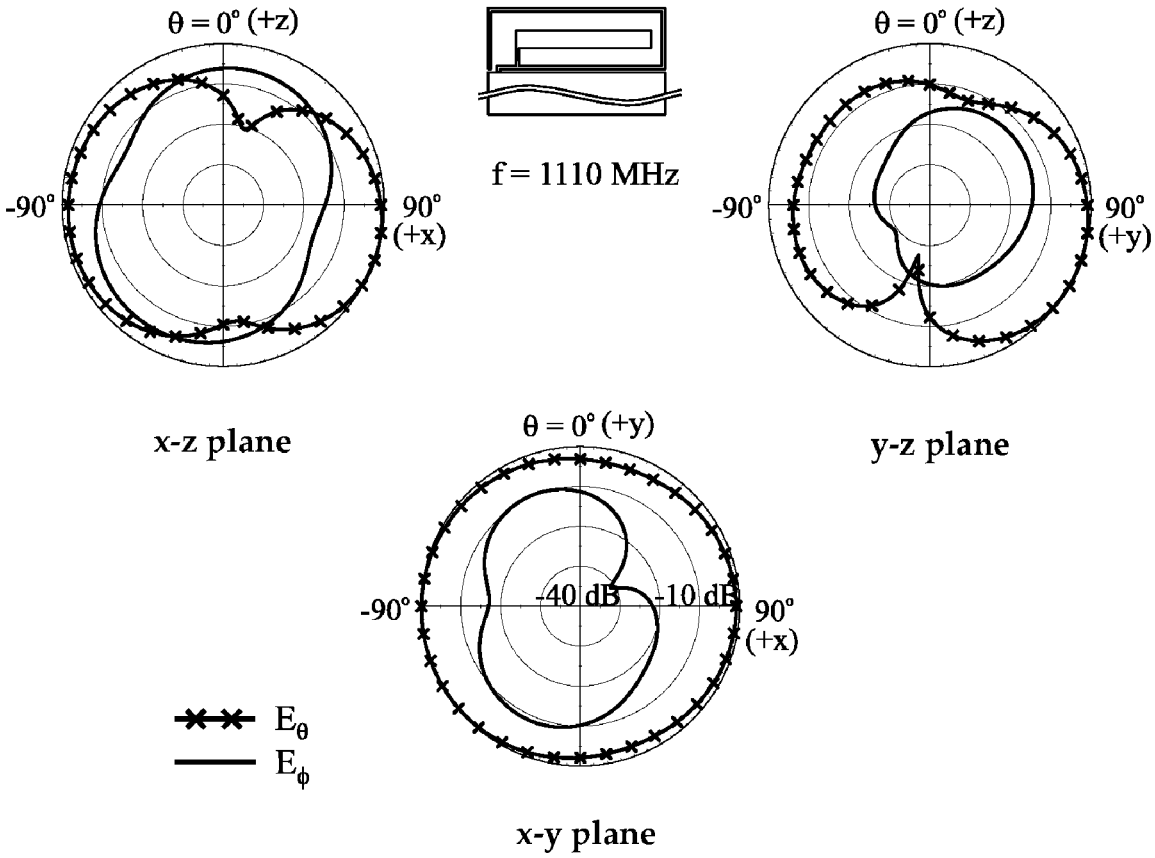
FIG. 4 illustrates the radiation pattern of the dual-band loop antenna at 1110 MHz according to the first embodiment of the present invention.

FIG. 4 illustrates the radiation pattern of the dual-band loop antenna at 1110 MHz according to the first embodiment of the present invention. As illustrated, the radiation pattern of the additional half-wavelength mode resulted from the resonance of the radiating metallic plate of the dual-band loop antenna at 1160 MHz according to the present invention is substantially similar to the radiation pattern resulted from the resonance of a conventional monopole antenna or planar antenna at the same frequency, i.e., both show a donut-shaped radiation pattern.

Figure 5:
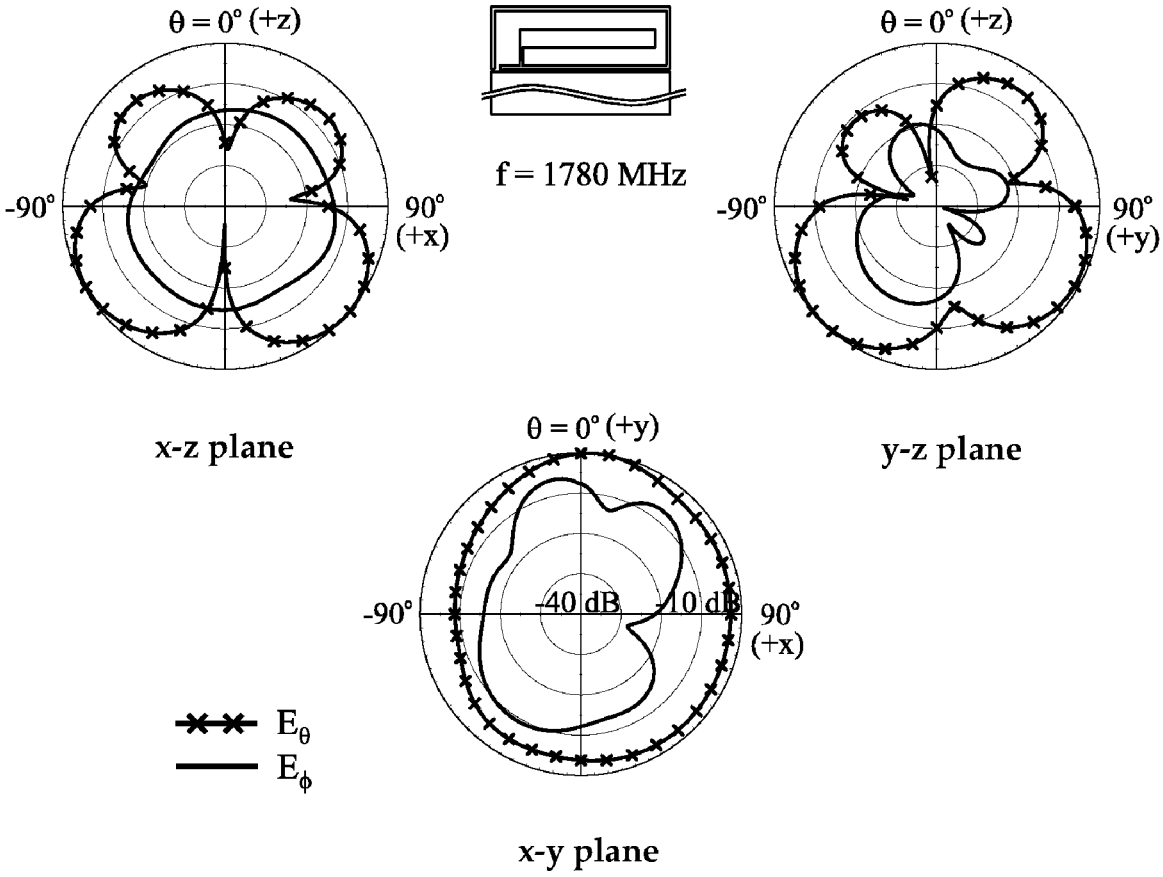
FIG. 5 illustrates the radiation pattern of the dual-band loop antenna at 1780 MHz according to the first embodiment of the present invention.

FIG. 5 illustrates the radiation pattern of the dual-band loop antenna at 1780 MHz according to the first embodiment of the present invention. As illustrated, the radiation pattern of the full-wavelength mode resulted from the resonance of the radiating metallic loop of the dual-band loop antenna at 1780 MHz according to the present invention show a pair of nulls on the x-y plane subject to the effect of zero current of the ground plane, however the presence of the pair of nulls does not affect the practical application of the antenna.

Figure 6:
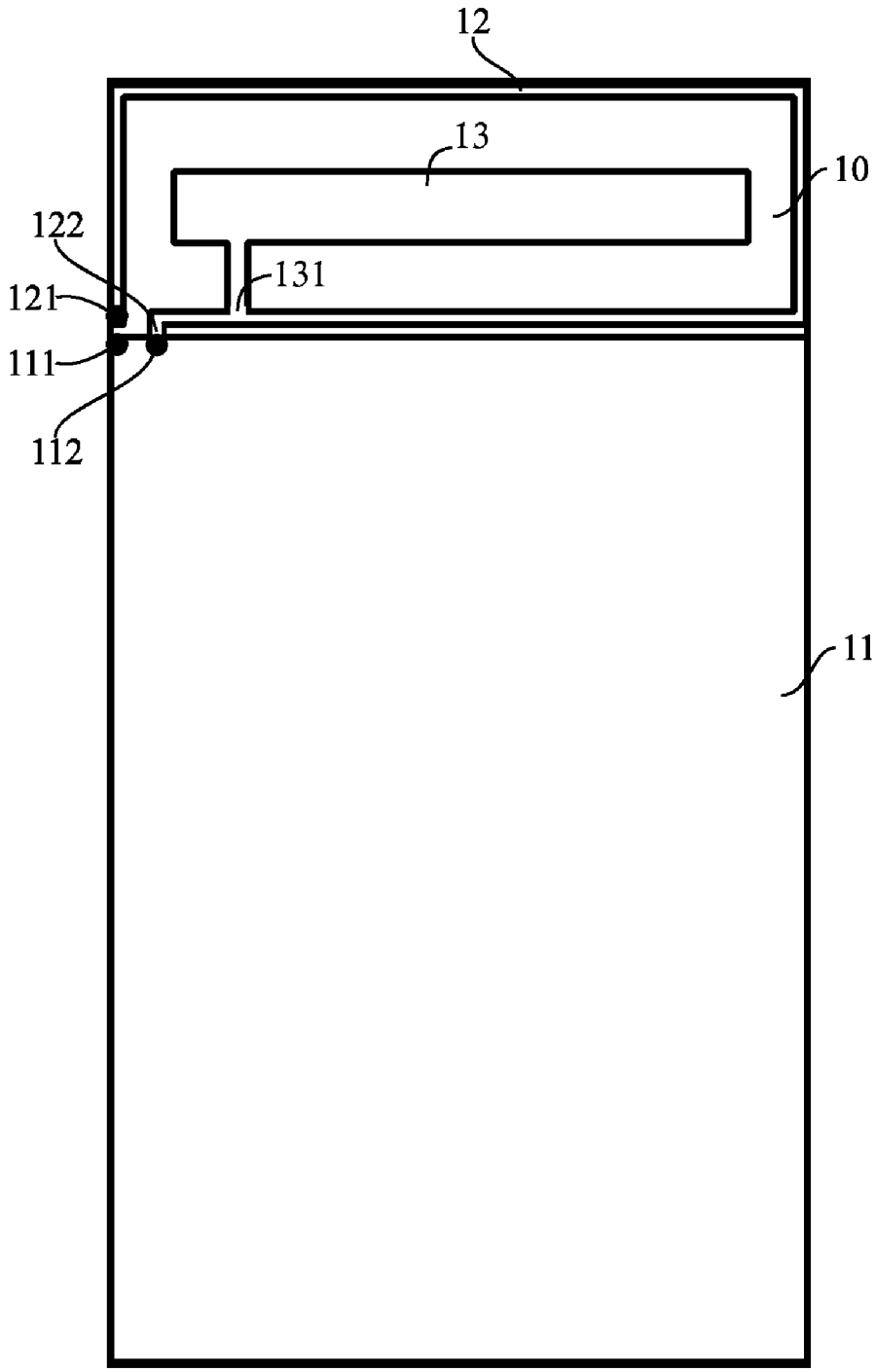
FIG. 6 is a schematic drawing showing the structure of a dual-band loop antenna in accordance with a second embodiment of the present invention.
Figure 7:
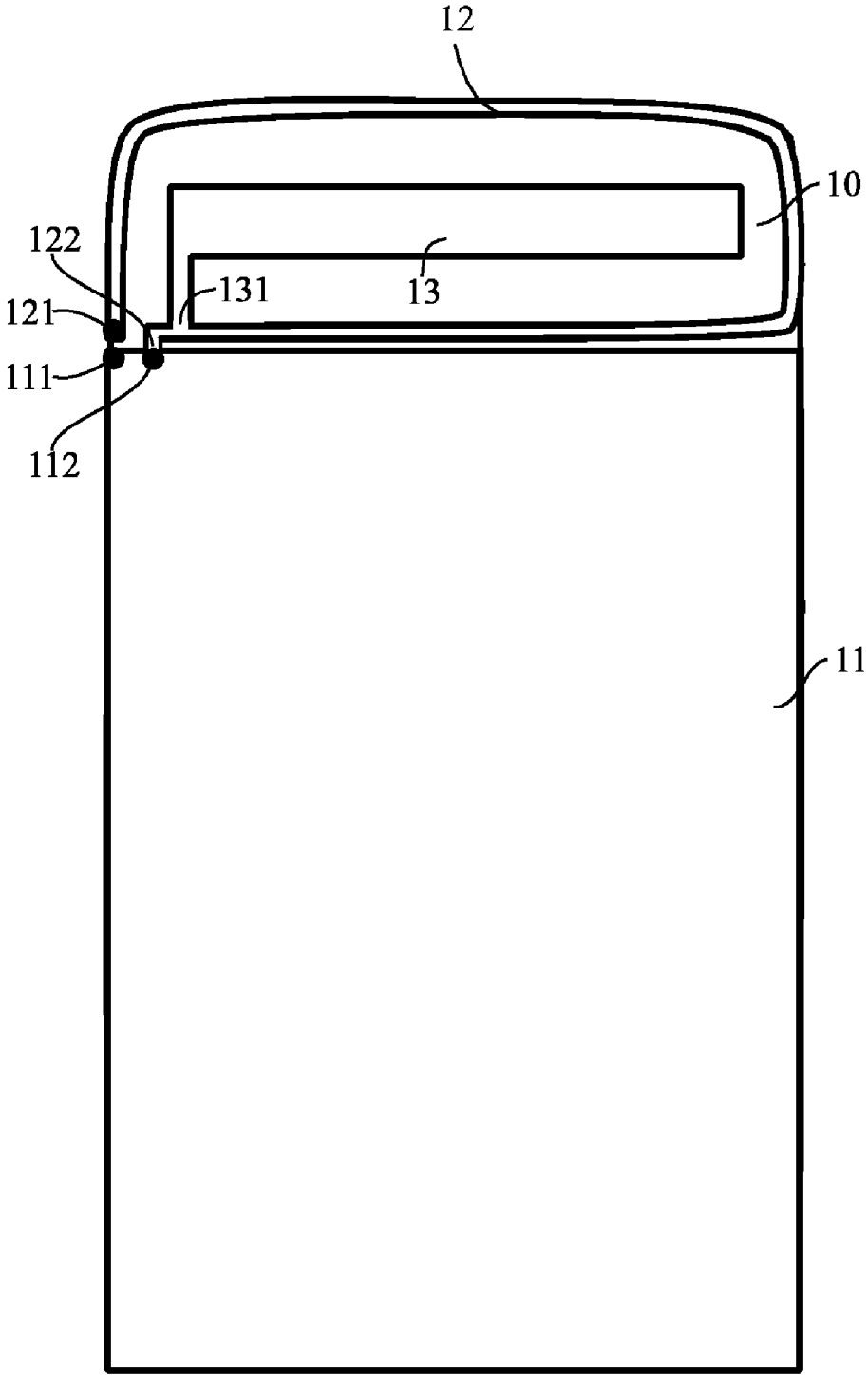
FIG. 7 is a schematic drawing showing the structure of a dual-band loop antenna in accordance with a third embodiment of the present invention.

FIGS. 6 and 7 show a dual-band loop antenna in accordance with a second embodiment and a third embodiment of the present invention respectively. These second and third embodiments are substantially similar to the aforesaid first embodiment with the exception that the radiating metallic plate 13 of the dual-band loop antenna according to the second embodiment of the present invention is of an asymmetric T-shape; the radiating metallic loop 12 of the dual-band loop antenna according to the third embodiment of the present invention has the shape of a rounded rectangle.

Both the aforesaid second and third embodiments can smoothly generate three resonant modes, achieving the same effect as the aforesaid first embodiment.

The result of the experiment according to the present invention shows that, the embodiments of the present invention can achieve wideband operation covering the GSM (890~960 MHz) and DCS (1710~1880 MHz) bands. The bandwidth for the lower band (GSM band) is about 250 MHz (890~1140 MHz) and the bandwidth for the upper band (DCS frequency band) is about 170 MHz, both meeting cell phone system requirements in practical application.

In conclusion, the dual-band loop antenna of the present invention has simple structure, low cost and good radiation characteristics; i.e., the dual-band loop antenna is valuable for practical application.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A dual-band loop antenna comprising:

a ground plane in a substantially rectangular shape, said ground plane comprising a grounding point and a shorting point;

a radiating metallic loop, said radiating metallic loop comprising a feeding end and a shorting end, said feeding end and said shorting end being spaced from each other at a predetermined distance, said shorting end being electrically connected to said shorting point of said ground plane; and a radiating metallic plate of an inverted-L shape surrounded by said radiating metallic loop, said radiating metallic plate comprising one end electrically connected to a vicinity around the shorting end of said radiating metallic loop and spaced from the shorting end of said radiating metallic loop at a distance shorter than 10 mm;

wherein the dual-band loop antenna generates a half-wavelength mode and a full-wavelength mode subject to the resonance of said radiating metallic loop, and an additional half-wavelength mode subject to the coupling between said radiating metallic plate and said radiating metallic loop.

2. The dual-band loop antenna as claimed in claim 1, wherein the predetermined distance between said feeding end and said shorting end is less than 5 mm.

3. The dual-band loop antenna as claimed in claim 1, wherein said ground plane, said radiating metallic loop and said radiating metallic plate are formed on a dielectric substrate by means of one of the techniques of printing and etching.

4. The dual-band loop antenna as claimed in claim 1, wherein said ground plane is a system ground plane of a mobile phone.

5. The dual-band loop antenna as claimed in claim 1, wherein said radiating metallic plate has the shape of a rounded rectangle.

6. The dual-band loop antenna as defined in claim 3, wherein said ground plane has a size 50×100 $mm^2$; said dielectric substrate has a thickness 0.8 mm; said radiating metallic loop has a width 0.5 mm and a length 127 mm and surrounds a 50×15 $mm^2$ rectangular area; the feeding end of said radiating metallic loop is spaced from the shorting end of said radiating metallic loop at a distance 1 mm; the side of said radiating metallic loop connected with the shorting point of said ground plane is spaced from said ground plane at a distance 0.5 mm; said radiating metallic plate is comprised of a metallic plate body having a size 4 mm long and 1 mm wide and a metallic arm having a size 41 mm long and 5 mm wide; the connecting area between said radiating metallic loop and said radiating metallic plate is spaced from the shorting end of said radiating metallic loop at 2.5 mm.

7. A dual-band loop antenna comprising:

a ground plane in a substantially rectangular shape, said ground plane comprising a grounding point and a shorting point;

a radiating metallic loop, said radiating metallic loop comprising a feeding end and a shorting end, said feeding end and said shorting end being spaced from each other at a predetermined distance, said shorting end being electrically connected to said shorting point of said ground plane; and a radiating metallic plate in an asymmetric T shape surrounded by said radiating metallic loop, said radiating metallic plate comprising one end electrically connected to a vicinity around the shorting end of said radiating metallic loop and spaced from the shorting end of said radiating metallic loop at a distance less than 10 mm;

wherein the dual-band loop antenna generates a half-wavelength mode and a full-wavelength mode subject to the resonance of said radiating metallic loop, and an additional half-wavelength mode subject to the coupling between said radiating metallic plate and said radiating metallic loop.

8. The dual-band loop antenna as claimed in claim 7, wherein the predetermined distance between said feeding end and said shorting end is less than 5 mm.

9. The dual-band loop antenna as claimed in claim 7, wherein said ground plane, said radiating metallic loop and said radiating metallic plate are formed on a dielectric substrate by means of one of the techniques of printing and etching.

10. The dual-band loop antenna as claimed in claim 7, wherein said ground plane is a system ground plane of a mobile telephone.

* * * * *